United States Patent [19]

Grimm

[11] Patent Number: 4,676,043

[45] Date of Patent: Jun. 30, 1987

[54] SPACE FRAME

[75] Inventor: Friedrich B. Grimm, Stuttgart, Fed. Rep. of Germany

[73] Assignee: Schueco Heinz Schuermann GmbH & Co, Bielefeld, Fed. Rep. of Germany

[21] Appl. No.: 829,695

[22] Filed: Feb. 13, 1986

[30] Foreign Application Priority Data

Feb. 13, 1985 [DE] Fed. Rep. of Germany ..... 3504807

[51] Int. Cl.[4] ..... E04H 12/00

[52] U.S. Cl. ..... 52/648; 403/171

[58] Field of Search ..... 52/648, DIG. 10, 645, 52/646, 80, 81; 403/170, 171, 172, 176, 217

[56] References Cited

U.S. PATENT DOCUMENTS 4,353,662 10/1982 Du Chateau ..... 52/648 X
4,551,960 11/1985 Fleishman ..... 52/648

FOREIGN PATENT DOCUMENTS 0081608 12/1981 European Pat. Off. .
2917422 11/1979 Fed. Rep. of Germany .
3406550 2/1984 Fed. Rep. of Germany ..... 52/648
410185 3/1945 Italy ..... 403/171
1283025 7/1972 United Kingdom ..... 403/171

*Primary Examiner*—Carl D. Friedman
*Assistant Examiner*—Naoko N. Slack
*Attorney, Agent, or Firm*—Michael J. Striker

[57] ABSTRACT

A space frame, comprises a plurality of joint elements, each of the elements including a plurality of releasably connectable bodies, each of the bodies having a plurality of connecting members; and a plurality of connecting pieces which are releasably connectable with the connecting members of the bodies so as to connect the joint elements at a distance from one another, the bodies of each of the joint elements being formed ring-shaped and arranged concentrically relative to one another, each of the bodies of each of the joint elements having a plurality of portions and being provided in each of the portions with an equal number of the connecting members.

17 Claims, 19 Drawing Figures

SPACE FRAME

BACKGROUND OF THE INVENTION

The present invention relates to a space frame which has a plurality of joint elements provided with connecting members. More particularly, it relates to such a space frame in which the above joint elements are formed as releasably connectable bodies having approximtely or polyhedral shape and connected with one another tubular and/or bar-shaped connecting pieces which are releasable connectable with the connecting members of the bodies, for example by means of screw connection.

Space frames of the above mentioned general type are disclosed, for example, in the DE-OS No. 2,917,422. The joint elements are composed in this space frame of hollow two-part metal balls with radial through openings. These metal balls have spatial access openings which are closed by caps. The caps are mounted on the balls by means of holding-down springs. The manufacturing and assembling of such joint elements is expensive since many manufacturing steps are required to obtain a finished ball from a workpiece. Another disadvantage of the known joint elements is that the region of the metal balls which is closed by the caps cannot be used for connecting with the connecting pieces and the force distribution on the the joint element is not uniform. It is possible to reduce the effect of this unfavorable force distribution for example by making greater the wall thickness of the hollow ball. However, this leads to an increased material consumption and further increase in costs of the joint elements.

Another space frame is disclosed in European patent application No. 0.081,608. The caps of the metal balls are provided with openings for the tubular bars. The connection of the both ball parts is performed by means of a screw which undesirably affects the mounting of the space frame because of the openings formed in the caps.

SUMMARY OF THE INVENTION

Accordingly, it is an object of the present invention to provide a space frame of the above mentioned general type which is easy and simple to assemble and in which connecting members on simply an expensively produced joint elements can be easily distributed in a uniform manner.

In keeping with these objects and with others which will become apparent hereinafter, one feature of the present invention resides, briefly stated, in that each of the joint elements is composed of a plurality of ring-shaped and concentric bodies, and each connecting wall portion of the wall of each of the bodies is provided with the same number of connecting members.

In accordance with an especially advantageous embodiment of the present invention, each of the joint elements includes three bodies which are arranged normal to one another so that the inner body is located in the immediate body, and the intermediate with the inner body is arranged in the outer body. In this case which is important for the practical utilization of the invention, each joint element which satisfies all the requirements of a space frame can be assembled in extremely simple and fast manner. The access into the inner space of the joint element is thereby the establishment of the connection with the connecting pieces is extremely simple and the connecting members of the joint element are accessible from all sides. The individual bodies can be formed as rings with widths which is only insignificantly greater than the diameter of the connecting piece on the connecting point with the body.

For guaranteeing the form locking and force transmitting connection of the joint elements in all applications, the inner body is connected with the intermediate and the outer body at an outer side of the inner body, whereas the intermediate body is connected with the inner body at an inner side of the intermediate and with the outer body at the outer side of the intermediate body.

In accordance with an especially advantageous feature of the present invention, the outer and inner contours of the bodies are polygonal, advantageously octagonal. The outer body is formed as a regular octagon with two diametrically opposite wall portions having a distance between its inner surfaces equal to x (cm), the intermediate body has two opposite wall portions having a distance between its outer surfaces equal to x (cm) and a shape corresponding to the shape of the outer body, and the inner body has two diagonally opposite wall portions with a distance between its outer surfaces equal to x (cm) and a shape correponding to the shape of the intermediate body. The above opposite wall portions of the inner body extend normal to the above wall portions of the intermediate body. In this case a joint element is formed which, despite all three wall portions extending normal to one another, has uniformly distributed connecting possibilities for the connecting pieces.

When in the joint element the connecting members are formed as radially extending and uniformly distributed openings in accordance with another feature of the present invention, the force distribution inside the joint element is especially favorable since the forces at opposite sides are compensated. The joint element cannot be deformed even when the bodies are composed of relatively thin walled rings.

In the joint elements in which the bodies are formed as for example circular rings, the desired form locking connection in force transmitting connection can be obtained when the connecting wall portions of the bodies are provided with the recesses of a complementary shape. When such bodies are composed of an elastic material in accordance with a further advantageous feature, the assembly of the individual joint elements is especially simple and fast.

In these joint elements it is advantageous to form the connecting member as projections such as tongues or ears. In this case it is advisable to form circular openings in the projections with axes extending normal to a connecting plane in which the above tounges or ears extend. In this embodiment of the invention the forces produced by the connecting pieces act uniformly tangentially upon the joint element. If the connecting pieces at their ends are bent perpendicularly, the forces act radially so that they are oppositely compensated.

The tongues or ears can be formed either at the inner side and between the connecting wall portions of each body, or at the outer side of the body.

When the space frame is designed in accordance with the present invention, it possesses significant advantages especially in a considerably simplification of the production of the joint elements and connecting bar members, as well as in simplification of the mounting procedure. When for example a joint element is produced with eighteen connecting members [for connecting bars], only three differently shaped rings each with eight openings are needed. The rings can be produced in a simple manner as portions of an extruded profile [aluminum], a cast profile [steel], or a cold or hot-deformed hollow profile.

After punching or drilling of eight through openings in each body [ring] and after eventual surface treatment, the individual parts of the joint element are ready for mounting.

The connecting technique in accordance with the present invention simplifies the construction of the connecting pieces as a result of it. The bar elements can be formed for example so that they are provided with threaded openings at its end sides. For the case when the connecting members [bar connecting faces] are impressed by extrusion [aluminum] in the body [ring], the connecting pieces [bar ends] must be formed so that they have complementary connecting faces. The individual joint element restores its final design and structural reinforcement by screwing with the connecting pieces. This provides for a principle simplification during the manufacture of space lattices.

It is expecially emphasized that there is a possibility of fast mounting with electrical screwing, and the degree of premounting on the ground and the mounting devices can be freely adjusted the general space. The exchange of connecting pieces can be performed at any one time without destroying the space frame.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanyin drawing.

DESCRIPTION OF PREFERRED EMBODIMENTS

Figure 1:
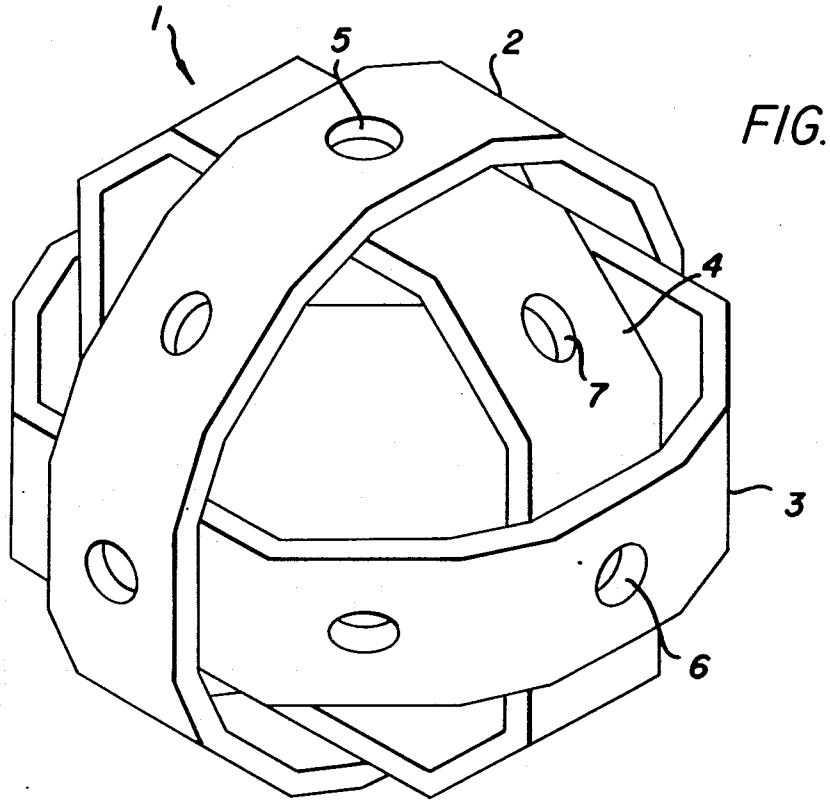
FIG. 1 is a view showing a joint element of the inventive space frame, composed of three bodies which are normal to one another.
Figure 1A:
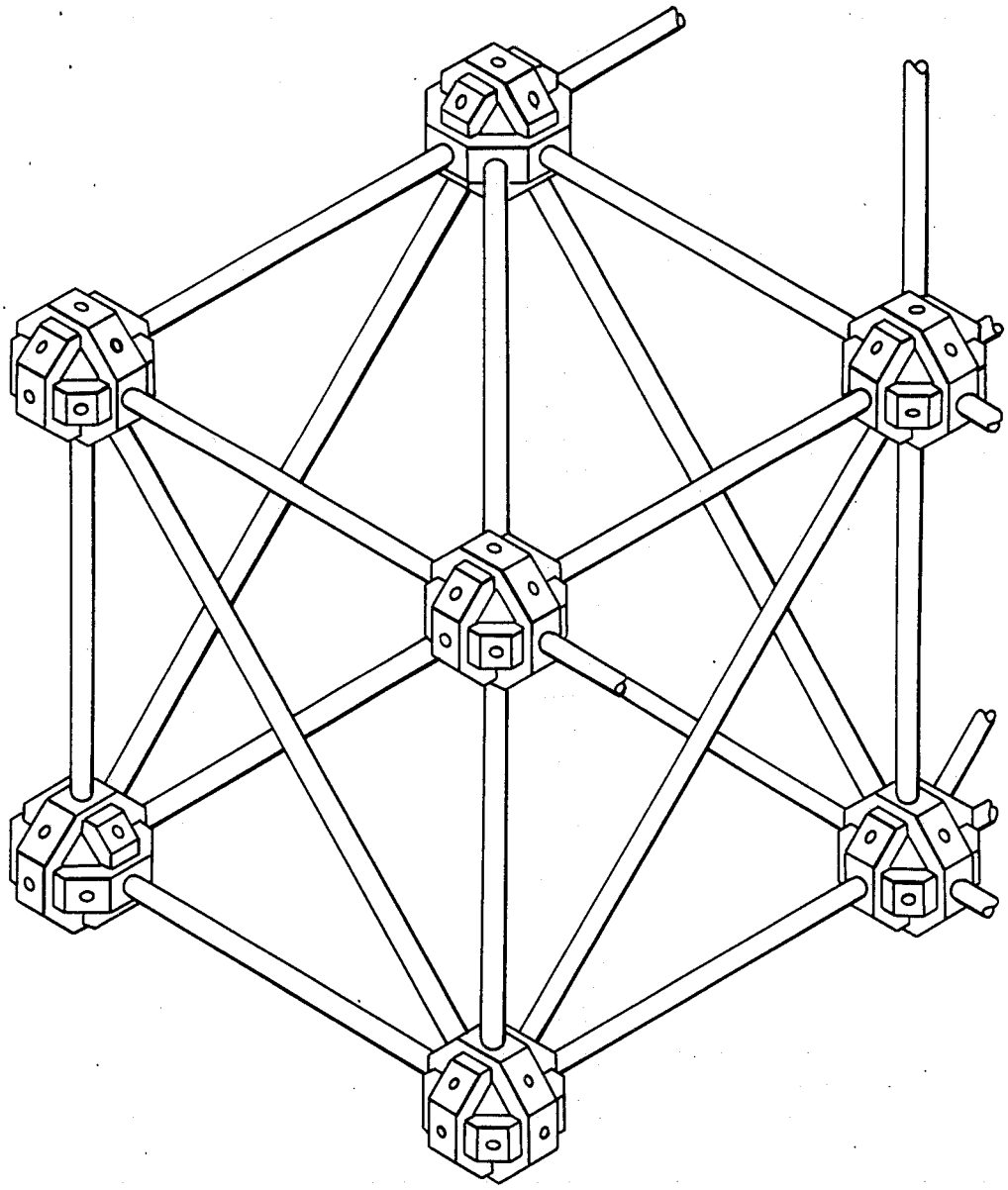

FIG. 1A shows a space frame which includes a plurality of joint elements provided with connecting members. The joint elements are formed as releasably connectable bodies with spherical or polyhedral walls. The space frame also has a plurality of tubular and/or bar-shaped connecting pieces which are releasably connectable with the connecting members of the joint elements arranged at a distance from one another, for example by means of screw connection. The bodies which form the joint elements are arranged in a ring-shaped manner and concentrically. Each body defines a connecting plane with equal number of the connecting members.

As shown in FIG. 1 each joint element 1 has three bodies 2, 3 and 4 which are arranged normal relative to one another. More particularly, each joint element 1 has an inner body 4, an intermediate body 3, and an outer body 2. The inner body 4 is located in the intermediate body 3, the intermediate body 3 is located in the outer body 2. Each of the three bodies 2, 3 and 4 has the same number of connecting members 5, 6 and 7. In the shown example, each body body 2, 3 and 4 has eight radially extending connecting members which are formed as openings.

The bodies 2, 3 and 4 of the joint element 1 are connected with one another so that the inner body 4 is connected with the intermediate body and with the outer body 2 at its outer side. The intermediate body 3 is connected with the inner body 4 at its inner side and with the outer body (2) at its outer side. Therefore both a force-transmitting connection and form-locking connection between the bodies 2, 3 and 4 is provided. This connection takes place in each of the embodiments which will be described hereinbelow.

The bodies 2, 3 and 4 have regions in which two of the bodies overlap one another. In these overlapping regions the connecting elements, which can be formed as openings 5 and 6 are formed so that the openings in the neighboring bodies are in alignment with each other. It is therefore possible to connect connecting pieces 10 and 11 [FIG. 4] with the joint element 1, for example by means of screws 12 and 13 which have different lengths. The heads of the screws 12 and 13 are located in the inner space of the joint element 1.

Each of the bodies 2, 3 and 4 is formed so that its outer contour and its inner contour are polygonal or circular.

Figure 5:
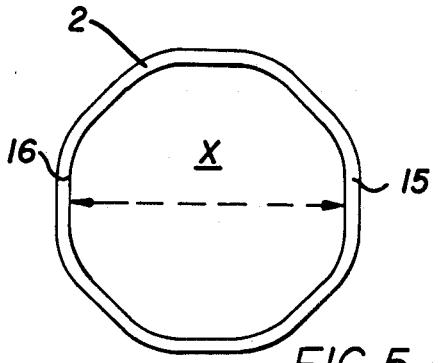
FIGS. 5, 6 and 7 are views showing the outer body, the intermediate body, and the inner body of the joint element of FIG. 4.
Figure 6:
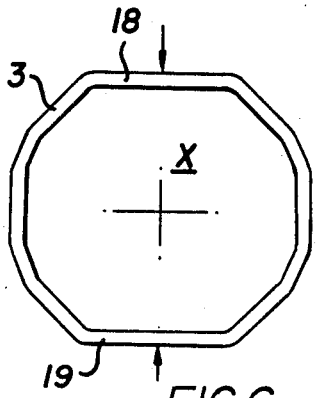

In the embodiment shown in FIGS. 1–7, each of the bodies 2, 3 and 4 has an octagonal outer contour and inner contour. The outer body 2 is a regular octagon with diagonally oppostie walls 15 and 16 having inner surfaces which are spaced from one another body a distance x (cm), as shown in FIG. 5. The intermediate body 3 has two diagonally opposite walls 18 and 19 with outer surfaces which are spaced from one another by a distance x (cm). The intermediate body 3 has a shape substantially corresponding to the shape of the outer body 2. The inner body 4 has one pair of diagonally opposite walls 20 and 21 and another pair of diagonally opposite walls 22 and 23. The outer surfaces of the walls 20, 21 and 22, 23 are spaced from one another by a distance x (cm).

Figure 2:
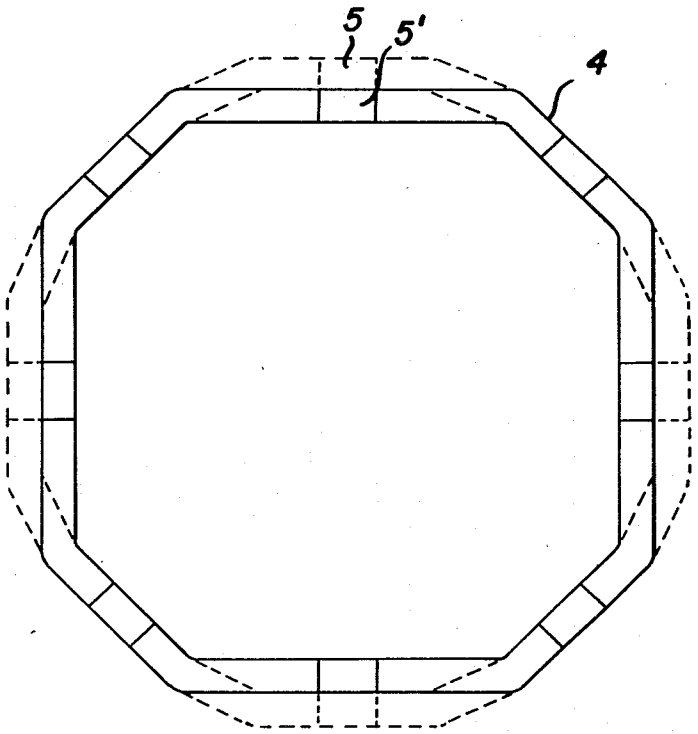
FIG. 2 is a vertical plan view of an inner body, showing the differences between an intermediate body and an outer body in dotted lines.

The distance between the inner body 4 and the outer body 2 is especially clearly recognizable from FIG. 2 in which the outer body 2 is shown in dotted lines. It can be seen that the openings 5 and 5' have the same center axes.

Figure 3:
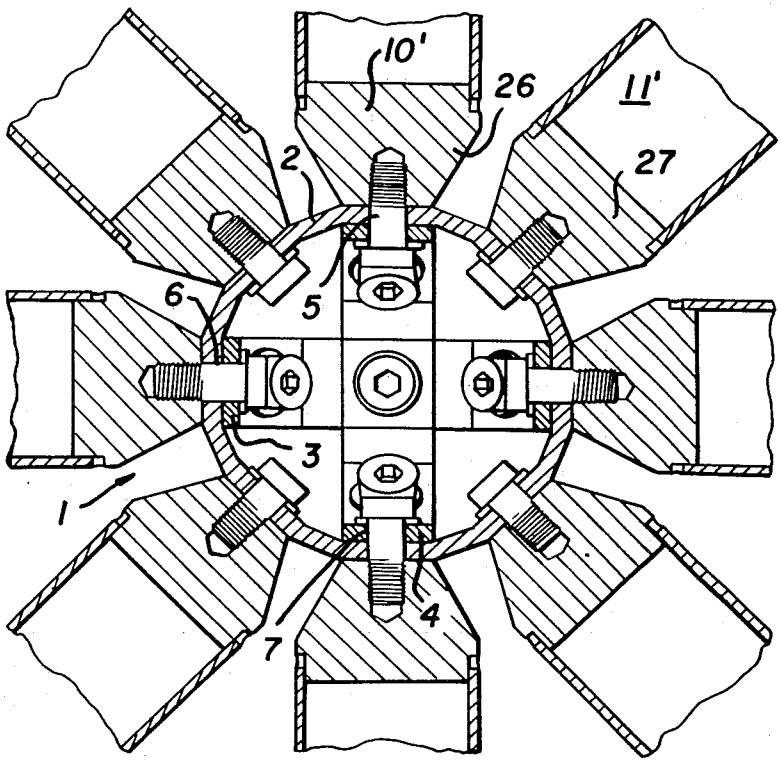
FIG. 3 is a view showing a section of one joint element with connecting pieces which are connected therewith by screwing.
Figure 4:
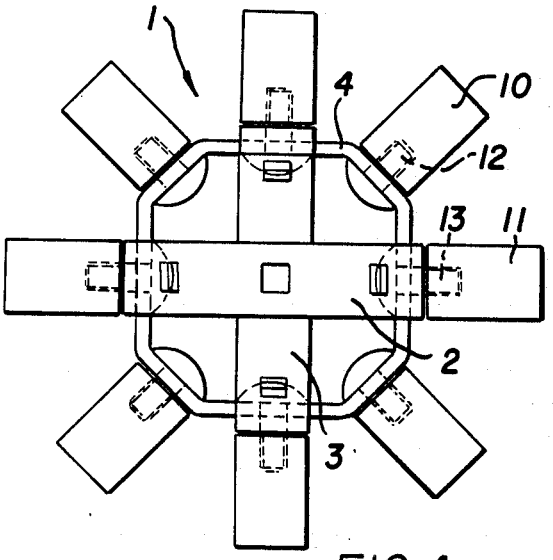
FIG. 4 is a plan view of a joint element having connecting pieces, in direction of the connecting plane of the outer body.
Figure 7:
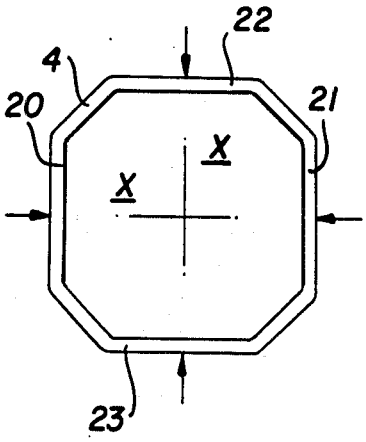
Figure 8:
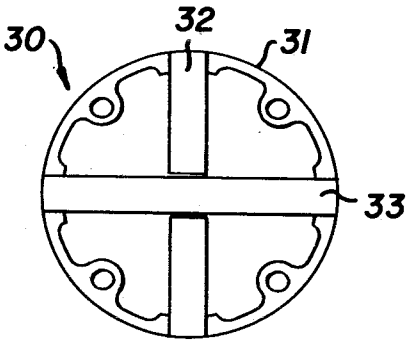
FIG. 8 is a view showing a further embodiment of the joint element in which the connecting members are formed as ears provided at the inner side of the body.
Figure 11:
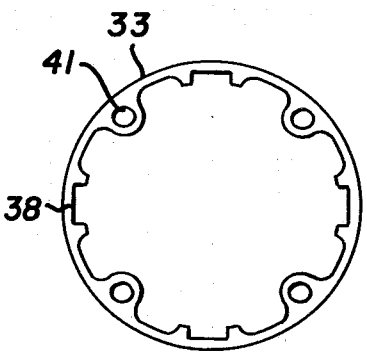
FIGS. 9, 10 and 11 are views showing the inner body, the intermediate body and the outer body of the joint element of FIG. 8.
Figure 10:
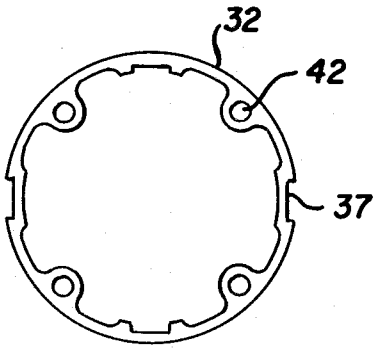
Figure 9:
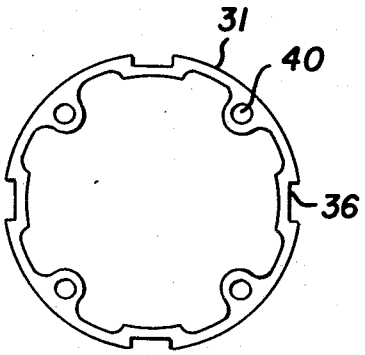
Figure 13:
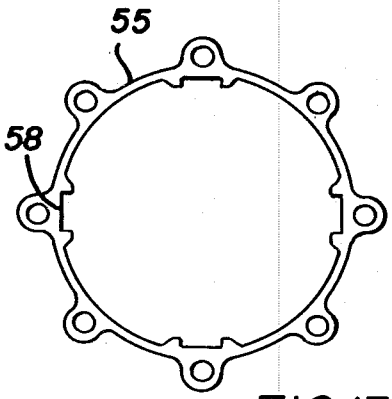
FIGS. 13, 14 and 15 are views showing the outer body, the intermediate body and the inner body of the joint element of FIG. 12.
Figure 15:
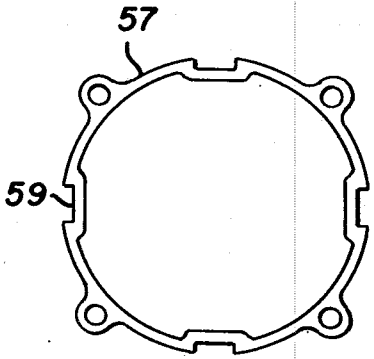

As can be seen from FIGS. 3 and 4, the joint elements 1 are connectable with the connecting pieces 10 and 11 or 10' and 11' having different diameters. The connecting pieces 10' and 11' of a greater diameter are provided with connecting portions 26 and 27 which narrow toward the joint element 1. Because of this an independence between the joint elements 1 and the connecting pieces 10' and 11' relative to their diameter is obtained. This is especially important when a user must have a space frame in which the joint elements must not appear. On the other hand, it is also possible to produce a space frame in which the joint elements are considerably greater as compared with the diameter of the connecting pieces and for example serve as a lamp housing.

FIGS. 8–11 show a joint element 30 with ring-shaped bodies 31, 32. 33 required therefor. The inner body 31 is provided in its outer wall with recesses 35 and 36 which are connectable with complementary recesses 37 and 38 of the intermediate body 32 and the outer body 33. Since these bodies are formed of an elastic material, a form locking connection and a force transmitting connection between the individual bodies is produced by deformation without any other means.

At the inner side of the bodies 31, 32 and 33, there are provided ears 40, 41 and 42. The ears 40, 41 and 42 are formed as connecting members of the joint element 30.

Figure 12:
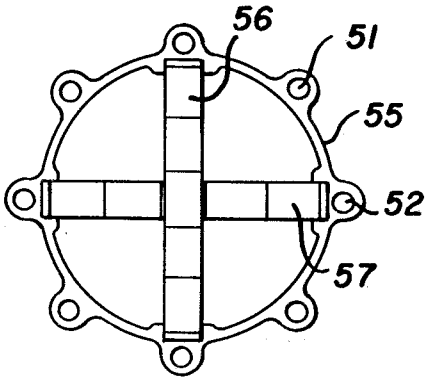
FIG. 12 is a view showing a further embodiment of the joint element in which the connecting members are formed as ears at the outer side of the body.
Figure 14:
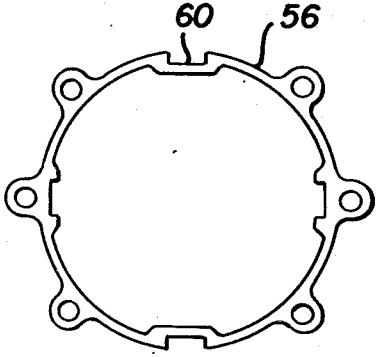

A joint element 50 shown in FIG. 12 is provided with ears 51 and 52 at an outer side of bodies 55, 56 and 57. In this case the bodies 55, 56 and 57 also have recesses 58, 59 and 60 which produce a form locking and a force transmitting connection between the bodies 55, 56 and 57.

The above presented examples clearly show that a new principle for production of joint elements to form space frames or space lattices is proposed. The structural blocks of this space lattice are bodies such as tetrahedron, hexahedron and octahedron. Theoretically, eighteen connecting pieces can be connected with each joint element. The joint elements are assembled of three different rings which can be cut as portions of three different tubular shaped members.

The three bodies [rings] which are arranged normally relative to one another in the joint element form, by means of threaded connection with the bars, a spatial structure. This spatial structure is similar to a hollow sphere in the sense of transmission of pulling and pressing forces.

The width, the thickness and the diameter of the bodies [rings] depends on one another, however are basically variable. In other words, the selection of one of these three variables determines the size of both other bodies [rings].

The ring-shaped bodies can also be formed with considerably greater ring thickness. It is possible to provide radially extending bearing shells which are accessible through inlet openings, as connecting members. The connecting pieces carry cylindrical bearing bodies which are connected with the connecting piece via a connecting web determined upon the inlet opening. The connecting pieces can be inserted transversely to the ring-shaped bodies into the bearing shells and fixed thereby expanding of the bearing body.

Figure 16:
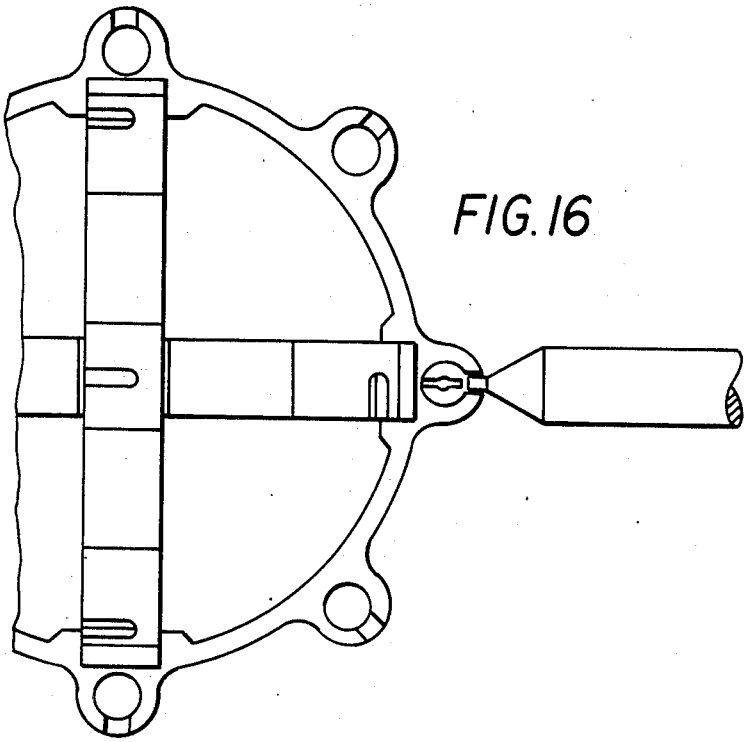
Figure 17:
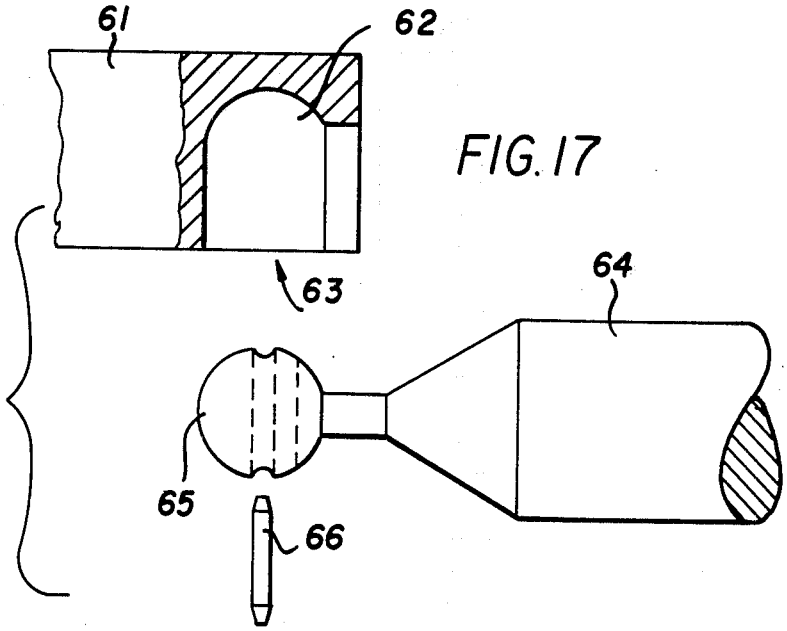
Figure 18:
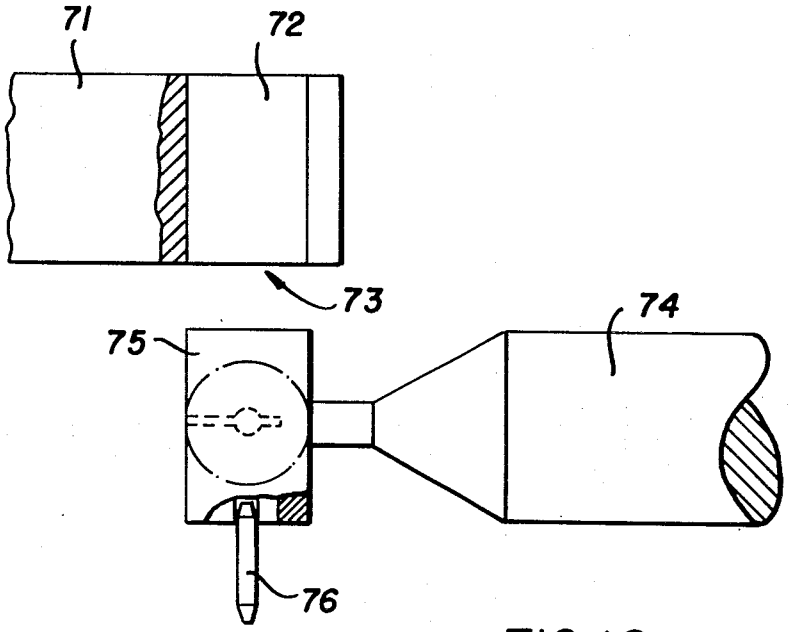

This is shown in FIGS. 16, 17 and 18. A joint element 61 in FIG. 17 has a bearing shell 62 which is formed as a blind hole and is provided with an inlet opening 63. A connecting piece 64 carries a cylindrical bearing body 65 which is insertable transversely into the bearing shell 62 of the joint element 61 and fixed therein by an expansion pin 66. As shown in FIG. 18, a bearing shell 72 of the joint element 71 can be cylindrical and provided with an inlet opening 73, and a bearing body 75 of a connecting member 74 can also be cylindrical and insertable into the bearing shell 72, wherein it can be fixed by an expansion pin 76.

It will be understood that each of the elements described above, or two or more together, may also find a useful application in other types of constructions differing from the types described above.

While the invention has been illustrated and described as embodied in a space frame with joint elements having connecting members, it is not intended to be limited to the details shown, since various modifications and structural changes may be made without departing in any way from the spirit of the present invention.

Without further analysis, the foregoing will so fully reveal the gist of the present invention that others can, by applying current knowledge, readilly adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A space frame, comprising a plurality of joint elements, each of said elements including a plurality of releasably connectable bodies, each of said bodies having a plurality of connecting members; and a plurality of connecting pieces which are releasably connectable with said connecting members of said bodies so as to connect said joint elements at a distance from one another, said bodies of each of said elements being formed ring-shaped and arranged concentrically relative to one another, each of said bodies of each of said joint elements having a wall with a plurality of wall portions and being provided in each of said wall portions with an equal number of said connecting members, said bodies including an inner body, an intermediate body, and an outer body, with said inner body being located in said intermediate body, and said intermediate body and said inner body being located in said outer body, each wall of said bodies having outer and inner surfaces, said outer body having its inner and outer contours formed as a regulator octagon and said wall of said outer body having diagonally opposite wall portions with a distance between its inner surfaces equal to x (cm), said wall of said intermediate body having two diagonally oppostie wall portions with a distance between its outer surfaces equal to x (cm) and a shape substantially corresponding to that of said outer body, said wall of said inner body having two diagonally opposite wall portions with a distance between its outer surfaces equal to x (cm) and a shape substantailly corresponding to that of said intermediate body, said wall portions of said wall of said inner body being normal to said wall portions of said intermediate body, each of said joint elements having a center joint, and said outer surfaces of said bodies of each of said joint elements being spaced at an equal radial distance from said center point of a respective one of said joint elements.

2. A space frame as defined in claim 1, wherein said connecting pieces are tubular.

3. A space frame as defined in claim 1, wherein said connecting pieces are bar-shaped.

4. A space frame as defined in claim 1; and further comprising screw means arranged for connecting said connecting pieces with said connecting elements of said bodies.

5. A space frame as defined in claim 1, wherein said wall portions of said wall of each of said bodies are flat.

6. A space frame as defined in claim 1, wherein said inner body is connected with said intermediate body and said outer body at an outer side of said inner body, said intermediate body being connected with said inner body at an inner side of said intermediate body and is also connected with said outer body at an outer side of said intermediate body.

7. A space frame as defined in claim 1, wherein each of said bodies has a center and a wall, said connecting members of each of said bodies being formed as a plurality of openings which extend radially and are uniformly distributed over said wall of said body.

8. A space frame as defined in claim 7, wherein said wall portions of said wall of each of said bodies include connecting wall portions, said connecting wall portions being provided with said openings so that an axle of one opening in one connecting wall portion of said one of said bodies concides with an axis of a respective one connecting wall portion of the other of said bodies.

9. A space frame as defined in claim 1, wherein said connecting members are formed as radially extending bearing shells which are accessible via inlet openings, said connecting pieces supporting cylindrical bearing bodies which are connected with each connecting piece with a connecting web which is determined in accordance with the inlet opening, and said bearing bodies are insertable into said bearing shells transversely to said ring-shaped bodies and fixed by expansion in the same.

10. A space frame, comprising a plurality of joint elements, each of said elements including a plurality of releasably connectable bodies, each of said bodies having a plurality of connecting members; and a plurality of connecting pieces which are releasably connectable with said connecting members of said bodies so as to connect said joint elements at a distance from one another, said bodies of each of said joint elements being formed ring-shaped and arranged concentrically relative to one another, each of said bodies of each of said joint elements having a plurality of portions and being provided in each of said portions with an equal number of said connecting members, each of said bodies having a wall with a plurality of said portions, said portions of each of said bodies including connecting wall portions with which said bodies are connected with one another, said connecting wall portions including recesses which are formed so that said recesses in said connecting portions of one of said bodies being complementary to said recesses of said connecting portions of the respective other of said bodies.

11. A space frame as defined in claim 10, wherein said bodies are composed of an elastic material.

12. A space frame, comprising a plurality of joint elements, each of said elements including a plurality of releasably connectable bodies, each of said bodies having a plurality of connecting members; and a plurality of connecting pieces which are releasably connectable with said connecting members of said bodies so as to connect said joint elements at a distance from one another, said bodies of each of said joint elements being formed ring-shaped and arranged concentrically relative to one another, each of said bodies of each of said joint elements having a plurality of portions and being provided in each of said portions with an equal number of said connecting members, said connecting members being formed as projections provided within each of said bodies.

13. A space frame as defined in claim 12, wherein said projections are formed as tongues.

14. A space frame as defined in claim 12, wherein said projections are formed as ears.

15. A space frame as defined in claim 12, wherein said projections extend in a predetermined connecting plane and each has a circular opening with an axis extending normal to said plane.

16. A space frame as defined in claim 12, wherein said portions of said wall of each of said bodies include connecting wall portions with which said bodies are connected with one another, said projections being formed at an inner side of said wall of each of said bodies and between said connecting wall portions.

17. A space frame as defined in claim 12, wherein said projections are provided at an outer side of said walls of said bodies.

* * * * *